United States Patent [19]

Ulics

[11] 4,403,786

[45] Sep. 13, 1983

[54] WHEELCHAIR SHOPPING BASKET

[76] Inventor: George Ulics, 1300 Venice, Dearborn, Mich. 48124

[21] Appl. No.: 229,186

[22] Filed: Jan. 28, 1981

[51] Int. Cl.[3] ..... A61G 5/02

[52] U.S. Cl. ..... 280/289 WC; 224/273; 297/174; 297/188; 297/DIG. 4

[58] Field of Search ..... 280/289 WC, 33.99 A, 280/33.99 F; 224/273; 297/153, 148, 174, 188, 194, DIG. 4

[56] References Cited

U.S. PATENT DOCUMENTS

| | | | |
|---|---|---|---|
| 2,868,275 | 1/1959 | Mize | 297/DIG. 4 |
| 4,054,315 | 10/1977 | Czarnowski | 297/153 |
| 4,081,198 | 3/1978 | Penney | 297/153 |
| 4,155,126 | 5/1979 | Classen | 297/153 |
| 4,158,428 | 6/1979 | Bates | 297/148 X |

*Primary Examiner*—John A. Pekar

*Attorney, Agent, or Firm*—Charles W. Chandler

[57] ABSTRACT

A wheelchair having means for releasably supporting a basket in front of the wheelchair occupant. The basket can be easily removed from the wheelchair by raising the basket above a pair of fingers mounted on opposite sides of the wheelchair. The fingers are carried by support means having a pair of laterally movable handles that engage the wheelchair frame.

5 Claims, 10 Drawing Figures

WHEELCHAIR SHOPPING BASKET

BACKGROUND OF THE INVENTION

This invention is related to wheelchairs, and more particularly to an improved support means for mounting a basket in front of the wheelchair occupant.

It is difficult for handicapped persons, confined to a wheelchair, to shop for groceries because they are normally limited by the means available for carrying the groceries. Some handicapped persons carry a box on their lap for the grocery items.

A prior art approach employs a floor-mounted stand, and a pair of baskets, supported on the stand, having a pair of spaced arms in a fixed position which clamp on opposite sides of the wheelchair frame.

The user mounts the basket onto the wheelchair when he enters the grocery store, fills the basket, and then upon completion of his shopping, returns the basket to the stand.

SUMMARY OF THE INVENTION

The broad purpose of the present invention is to provide a basket for a wheelchair which the user can easily remove from the wheelchair without using a separate stand. In the preferred embodiment of the invention, the basket is mounted on a pair of arms connected to opposite sides of the wheelchair. The two arms have fingers that are received in the rear wall of the basket so that the user can lower the basket onto the fingers. He removes the basket by raising the basket from the fingers. A tray is also mounted on the arms.

The two arms are laterally movable so that the user can easily either engage the arms with or release therefrom the tubular frame of the wheelchair.

Still further objects and advantages will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENTS

Figure 1:
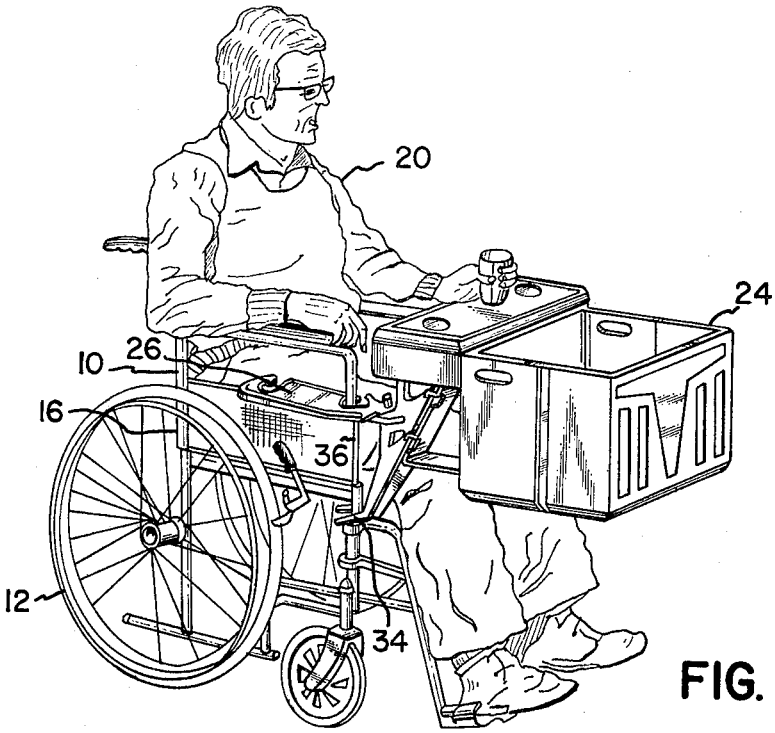
FIG. 1 is a perspective view illustrating the preferred basket and tray mounted on a wheelchair.
Figure 2:
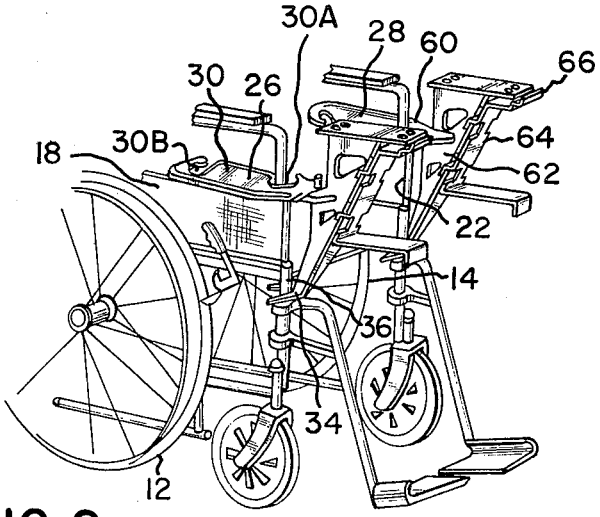
FIG. 2 is a fragmentary view showing the basket and tray removed from the wheelchair, with the locking arms in position.

Referring to the drawings, FIGS. 1 and 2 illustrate a conventional wheelchair 10 having wheel means 12 and 14 supporting a frame 16. Frame 16 has a seat structure 18 for supporting an occupant 20 in the manner known to one skilled in the art.

The frame has an opening 22 for receiving the occupant to a seated position on structure 18. A basket 24 is mounted by support means 26 and 28 on opposite sides of frame opening 22. Support means 26 and 28 are identical to one another except for a right and left hand relationship so that a description of support means 26 also applies to support means 28.

Figure 3:
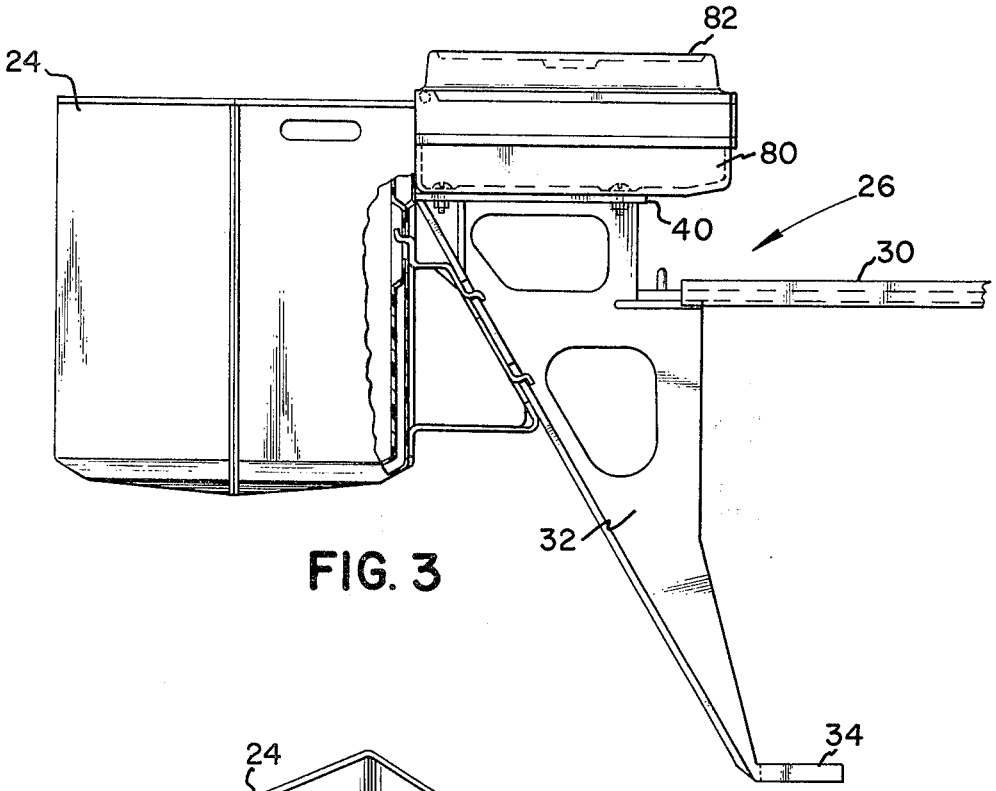
FIG. 3 is an elevated view of one of the locking arms connected to the tray and the basket, a part of the basket being illustrated in section.

Referring to FIGS. 2 and 3, support means 26 includes a horizontal arm 30 having a cut-out portion 30A for receiving frame 16. A second cut-out portion 30B is also provided in arm 30 for accomodating other commercially-available wheelchair frames.

Figure 5:
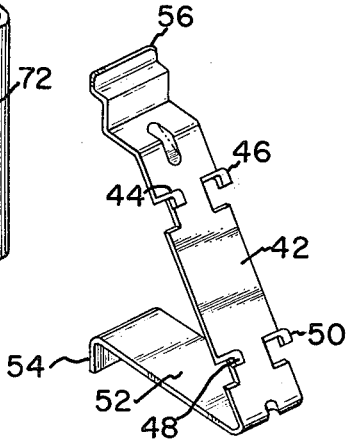
FIG. 5 is a view of one of the clips for supporting the basket.
Figure 6:
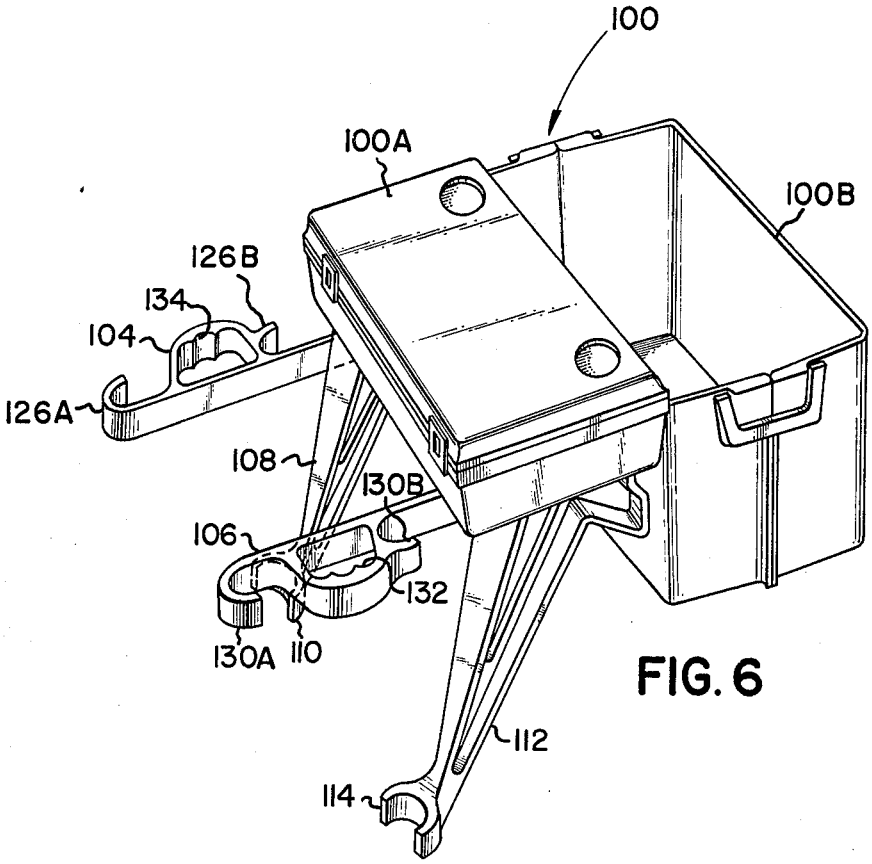
FIG. 6 is a perspective view of another embodiment of the invention.
Figure 9:
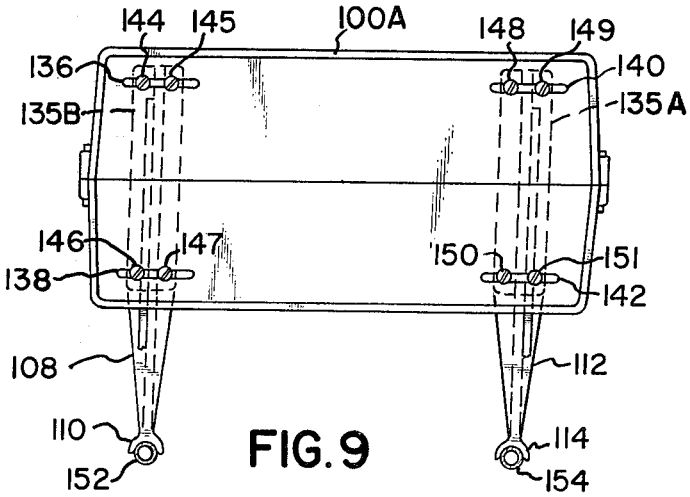
FIG. 9 is a plan view of the tray and arms of FIG. 6, the flexible arms being broken away for descriptive purposes.

Referring to FIGS. 3 and 5, an inclined arm 32 pivotally supports arm 30, has a fork 34 at its lower end for receiving a vertical member 36 of the frame. A pad 40 is carried on the upper end of the inclined arm. A clip 42 has bent fingers 44, 46, 48, and 50 hooked in notches formed along the side edges of support arm 32. The clip also has a horizontal base 52 terminating in a vertical end 54. The upper end of clip 42 has a finger 56.

Similarly, support means 28 includes a horizontal arm 60, an inclined arm 62 pivotally connected to horizontal arm 60, and a clip 64 mounted on the inclined arm. Clip 64 has a finger 66 similar to finger 56.

Figure 4:
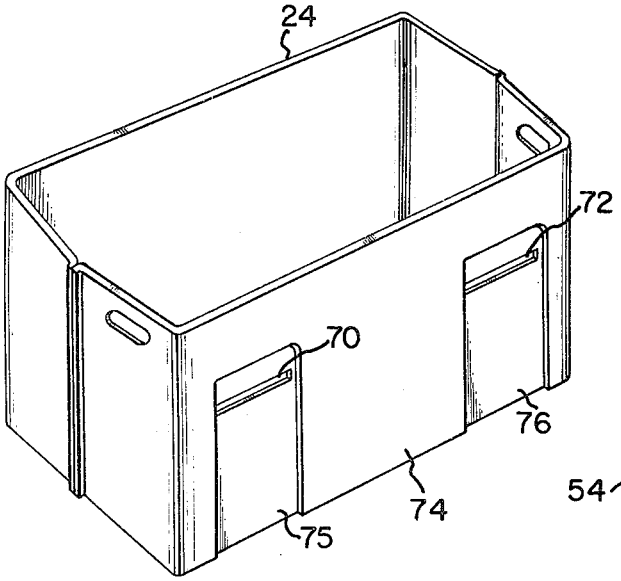
FIG. 4 is a perspective view of the basket.

Referring to FIG. 4, basket 24 has a pair of horizontally spaced slots 70 and 72 in rear wall 74. Slots 70 and 72 are adapted to receive fingers 56 and 66. The slots are horizontally spaced to accomodate the distance between the two clips which depends upon the adjusted distance between the sides of the wheelchair frame. Wall 74 has a pair of recesses 75 and 76 for guiding fingers 56 and 66 toward the slots.

It is to be noted that fingers 56 and 66 are vertically supported to receive the basket by a downward motion toward the fingers which passes them through the rear basket wall. A tray 80 with a lid 82 is seated on the pads on the two inclined arms.

Referring to FIGS. 6 to 10, another preferred basket means 100 is illustrated for mounting tray 100A and basket 100B on a wheelchair frame 102. This embodiment of the invention employs a pair of horizontal spaced arms 104 and 106. An inclined arm 108 is fastened to the outer end of arm 104 and has a lower hook 110 for engaging a lower vertical tubular wheelchair frame member. Similarly, an inclined arm 112 has its upper end connected by fastener means to horizontal arm 106. A lower hook 114 carried on the lower end of arm 112 provides means for mounting the arm on the opposite wheelchair frame member, in the same manner as illustrated in the embodiment of FIG. 1.

Figure 7:
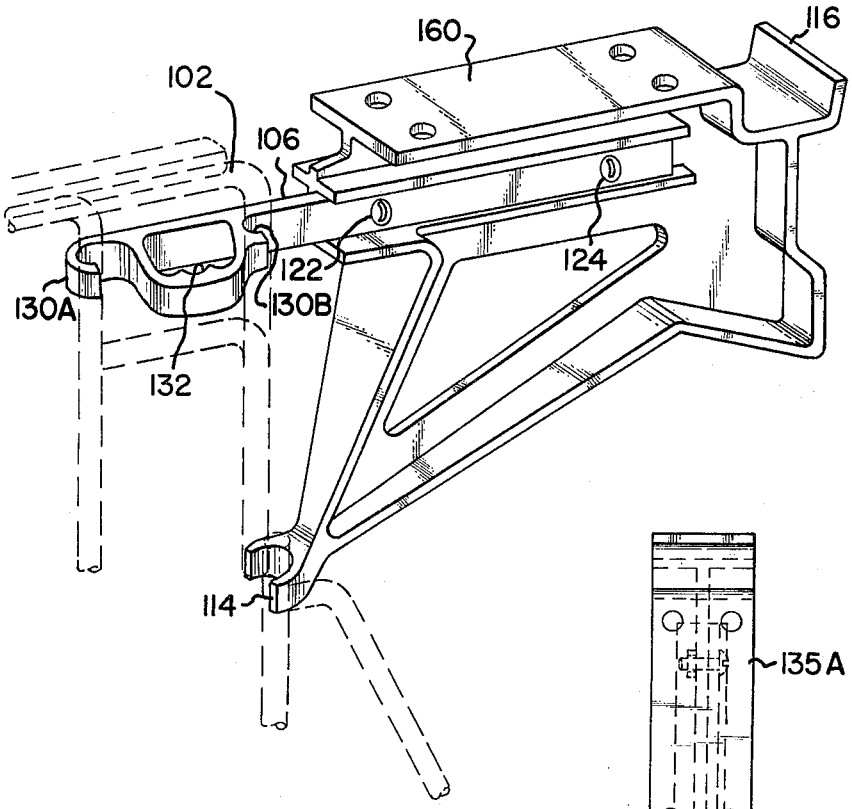
FIG. 7 is a perspective view of one of the supporting arms of the embodiment of FIG. 6, the wheelchair being illustrated in phantom.
Figure 10:
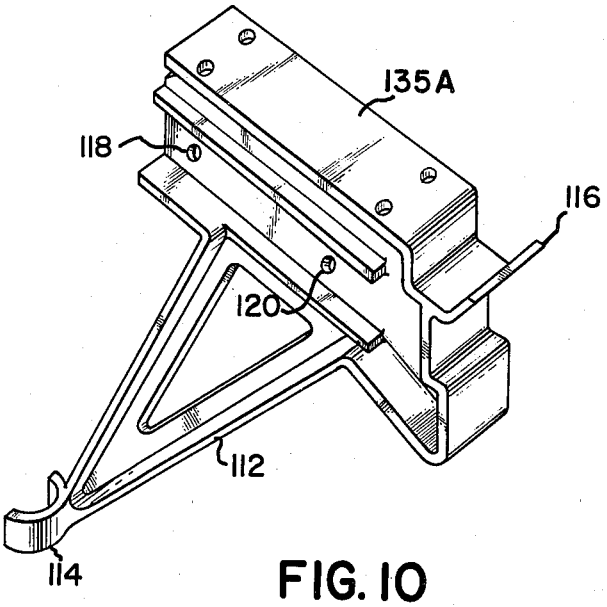
FIG. 10 is another view of the arm of FIG. 7.

The two inclined arms are similar to one another except for a right and left hand relationship so a description of one applies to the other. Each inclined arm carries a finger 116 which is receivable in slots (not shown) in the rear wall of basket 100B, similar to slots 70 and 72 of basket 24. Referring to FIGS. 7 and 10, each inclined arm has a pair of holes 118 and 120. Fastener means 122 and 124 provide means for connecting the outer end of horizontal arm 106 to inclined arm 112.

The two horizontal arms 104 and 106 are identical to one another except for a right and left hand relationship so the description of one also applies to the other. Arm 104 has two upper hook means 126A and 126B, and arm 132 has hook means 130A and 130B for engaging the upper vertical tubular frame members of the wheelchair accomodating the horizontal distance between the two fingers 116.

The outer end of arm 106 has an opening forming a handle 132 for the user to grasp the arm. Similarly, the outer end of arm 104 has an opening forming a handle 134 adjacent hook means 126A and 126B so that the user can grasp the two arms and remove the basket structure from the wheelchair.

Figure 8:
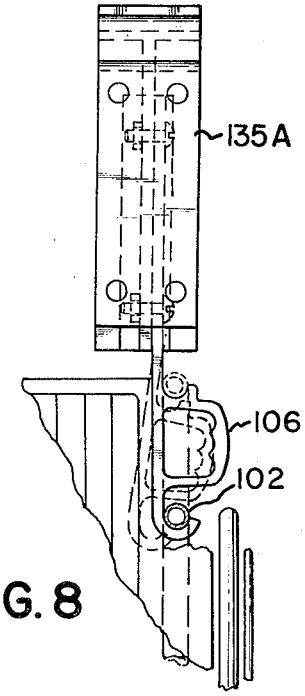
FIG. 8 is a fragmentary view of one of the supporting arms of the embodiment of FIG. 6.

Referring to FIG. 8, it is to be noted that each arm is resilient so that the user, by pulling toward him and pushing the two arms toward one another, can move hook means 126A and 126B, and 130A and 130B toward one another to pass between the supports of the wheelchair frame before engaging the vertical tubular frame members. The upper end of inclined arm 112 supports a pad 135A while the upper end of arm 108 supports a pad 135B. The bottom of tray 100A has four slots 136, 138, 140, and 142 for receiving fastener means 144, 145, 146, 147, 148, 149, 150, and 151 to fasten the tray to the two inclined arms at a distance accomodating the distance between the vertical tubular wheelchair frame members 152 and 154.

The embodiment of the invention illustrated in FIGS. 6 to 10 provides an arrangement for supporting the combination of a grocery carrying basket, as well as a tray while providing the user the utility of being able to readily remove the basket when it is not to be used. The horizontal arms are adjustable with respect to the basket-supporting fingers to accomodate different types of commercially available wheelchair structure. The flexible handles permit the user to readily lock the assembly onto a wheelchair and then to quickly release it and lift the tray structure from the wheelchair. The basket can easily be removed or separated from the tray structure simply by lifting it from the fingers carried on the inclined arms.

Having described my invention, I claim:

1. A Combination comprising, a wheelchair having a frame;

wheel means supporting the frame;

seating structure mounted on the frame;

the frame having an opening for receiving an occupant to a seated position on the seating structure;

a basket having opening means and a vertical wall having a pair of spaced slots;

support means comprising, a pair of horizontal support arms each connected to the wheelchair frame in a horizontal position;

a pair of inclined arms each having a lower end mounted on the wheelchair frame and an upper arm connected to one of said horizontal arms;

a clip mounted on each of the inclined arms;

a vertically disposed finger carried on each of said clips, said fingers being removably received in the pair of spaced slots in the vertical wall of the basket on opposite sides of the frame opening so as to be disposed to receive the opening means in the basket to support it in a position adjacent the frame opening in front of an occupant seated therein.

2. A combination as defined in claim 1, including a tray mounted on the inclined arms in a position between the basket and the seated position of the wheelchair occupant.

3. A combination comprising, a wheelchair having a tubular frame;

wheel means supporting the frame;

seating structure mounted on the frame, the frame having an opening for receiving an occupant in a seated position on the seating structure;

a basket;

a pair of spaced upper arm means on opposite sides of the seating structure, each of said arm means having a first end and a second end;

means connecting the first end of each arm to the basket such that the opposite, second end is moveable thereto;

a first hook on the second end of each of said arms engageable with the tubular frame;

a pair of lower arms disposed below the upper arm means, and a second hook carried on each of said lower arms engageable with a lower portion of the tubular frame such that the basket is supported in a cantilever fashion with respect to the upper arm means above the lower arms.

4. A combination as defined in claim 3, including means for adjusting the distance between the two upper arm means.

5. A combination as defined in claim 3, including a tray mounted on the spaced upper arms between the basket and the seated position of the occupant.

* * * * *